US007059744B2

(12) United States Patent
Sharrah

(10) Patent No.: US 7,059,744 B2
(45) Date of Patent: Jun. 13, 2006

(54) FLASHLIGHT HAVING BACK LIGHT ELEMENTS

(75) Inventor: Raymond Sharrah, Collegeville, PA (US)

(73) Assignee: Streamlight, Inc., Eagleville, PA (US)

( * ) Notice: Subject to any disclaimer, the term of this patent is extended or adjusted under 35 U.S.C. 154(b) by 46 days.

(21) Appl. No.: 10/703,993

(22) Filed: Nov. 7, 2003

(65) Prior Publication Data

US 2005/0099804 A1 May 12, 2005

(51) Int. Cl.
*F21L 4/02* (2006.01)

(52) U.S. Cl. ..... 362/208; 362/184

(58) Field of Classification Search ..... 362/184–186, 362/202, 205, 208, 228, 102
See application file for complete search history.

(56) References Cited

U.S. PATENT DOCUMENTS

| | | | | | |
|---|---|---|---|---|---|
| 1,203,576 | A * | 11/1916 | Broadhead | 340/321 |
| 1,645,487 | A * | 10/1927 | Harling | 340/321 |
| 1,671,744 | A * | 5/1928 | Rosenberg | 362/205 |
| 1,816,065 | A * | 7/1931 | Weidman | 362/184 |
| 2,716,700 | A * | 8/1955 | La France | 362/184 |
| 3,003,057 | A * | 10/1961 | Cheng | 362/184 |
| 4,135,230 | A * | 1/1979 | Armbruster | 362/206 |
| 5,067,058 | A | 11/1991 | Standley | |
| D353,055 | S | 12/1994 | Kish et al. | |
| 5,755,644 | A | 5/1998 | Breems | |
| 5,800,045 | A | 9/1998 | Kish et al. | |
| 5,871,272 | A * | 2/1999 | Sharrah et al. | 362/184 |
| 6,168,288 | B1 * | 1/2001 | St. Claire | 362/184 |
| 6,305,818 | B1 * | 10/2001 | Lebens et al. | 362/184 |
| 6,331,062 | B1 * | 12/2001 | Sinclair | 362/200 |
| 6,439,733 | B1 | 8/2002 | Fischer et al. | |
| 6,450,659 | B1 | 9/2002 | Salatino | |
| 6,523,972 | B1 | 2/2003 | Sharrah et al. | |
| 6,565,241 | B1 | 5/2003 | Glynn | |
| 2002/0149928 | A1 * | 10/2002 | Watterson et al. | 362/184 |
| 2002/0191396 | A1 * | 12/2002 | Reiff et al. | 362/246 |
| 2003/0156407 | A1 * | 8/2003 | Galli | 362/205 |
| 2005/0094388 | A1 * | 5/2005 | Booty | 362/184 |

OTHER PUBLICATIONS

Webster's II New College Dictionary, published 1995, Houghton Mifflin Co. p. 559.*

The "10 Mile Light", Birght Star Product Brochure published before Nov. 7, 2003, 2 pages.

* cited by examiner

*Primary Examiner*—Sandra O'Shea
*Assistant Examiner*—Robert May
(74) *Attorney, Agent, or Firm*—Stephen H. Eland; Dann, Dorfman, Herrell and Skillman

(57) ABSTRACT

A battery powered flashlight is provided having a primary lamp assembly providing a high powered light source in a forward direction, and a back light providing a lower powered light source in a rearward facing direction. Preferably, the flashlight includes a hollow housing having a back wall into which one or more apertures are formed for receiving one or more back light elements.

51 Claims, 6 Drawing Sheets

FLASHLIGHT HAVING BACK LIGHT ELEMENTS

FIELD OF THE INVENTION

The present invention relates to portable lights, such as battery-powered flashlights. More specifically, the present invention relates to a flashlight having a primary light source providing forward facing light and a secondary light source providing rearward facing light.

BACKGROUND

Flashlights are used in a variety of fields and a variety of applications. In certain applications, such as, low light, obstructed view light applications, it is difficult to see the operator from behind, since the beam of light from the flashlight is shining forwardly. For instance, in emergency applications, such as in firefighting applications, emergency personnel using a flashlight shining forwardly may not be easily seen due to difficulties or obstructions arising from the fire and smoke. In such applications, it is important to be able to quickly locate and identify the emergency personnel. Furthermore, flashlights used in emergency applications should be configured to withstand adverse conditions and significant abuse that arises when responding to emergency situations.

SUMMARY OF THE INVENTION

In light of the foregoing, the present invention provides a flashlight having a primary lamp facing forwardly to provide a primary light source. In addition, the flashlight provides a back light directed rearwardly, so that the back light allows the flashlight to be easily identified from behind, thereby making it easier to identify an emergency personnel using the flashlight in an emergency situation. In addition, the back light is designed to withstand the harsh environment and abuse that is common in emergency situations.

More specifically, the present invention provides a flashlight having a housing and a lamp assembly connected with the forward end of the housing to provide a light source directed forwardly. The flashlight further comprises a back light at the rearward end of the housing to provide a light source directed rearwardly. Preferably, the back light comprises an LED. In addition, preferably, the housing includes an aperture for receiving the back light thereby reducing the portion of the back light that projects rearwardly from the housing. By doing so, the back light is protected so that is less likely to be damaged during use. The flashlight further includes a switch for controlling the operation of the lamp assembly and the back light.

DESCRIPTION OF THE DRAWINGS

The foregoing summary and the following detailed description will be better understood when read in conjunction with the drawings, in which.

DETAILED DESCRIPTION OF THE PREFERRED EMBODIMENTS

Figure 1:
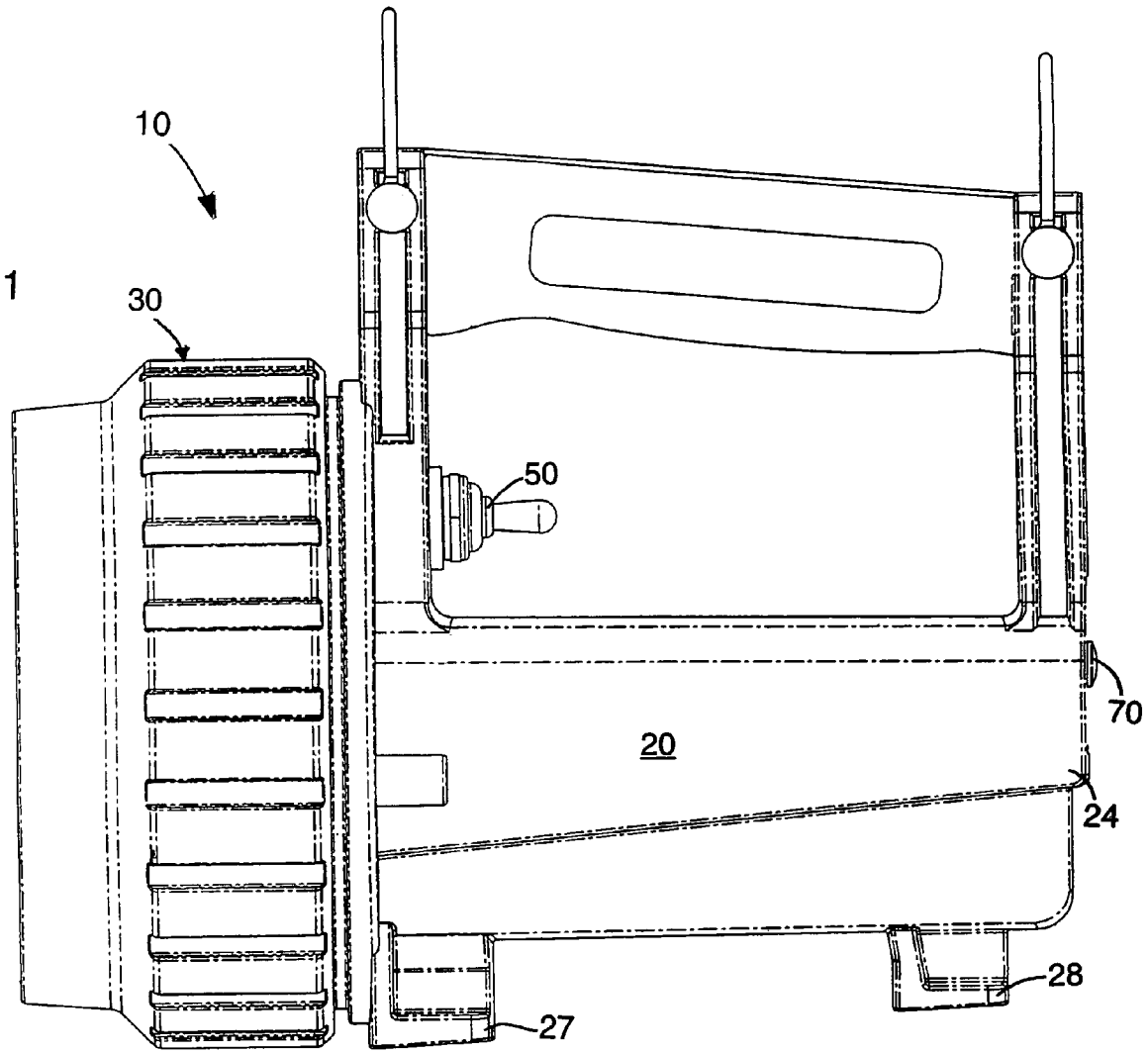
FIG. 1 is a side elevational view of a flashlight.
Figure 3:
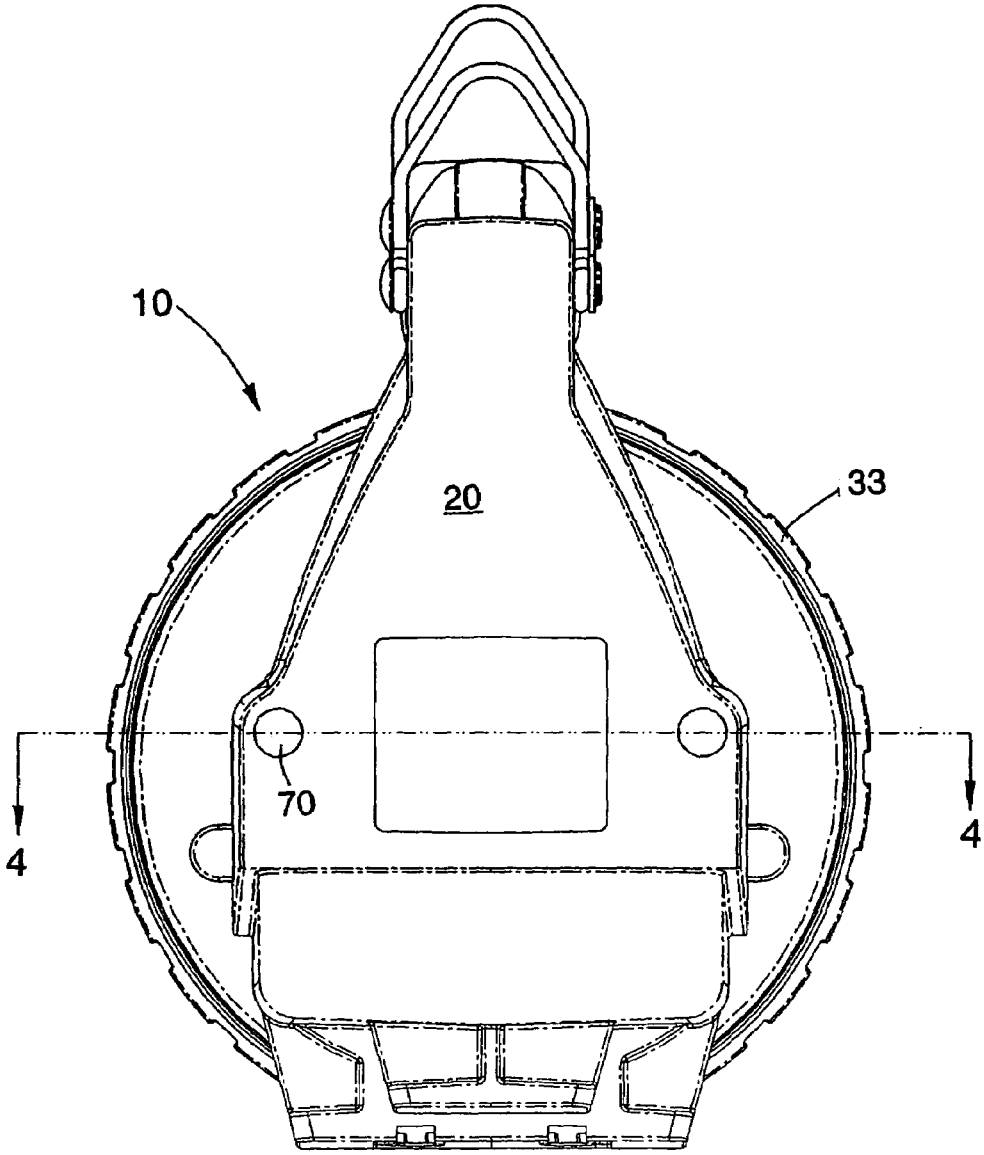
FIG. 3 is a rear elevational view of the flashlight illustrated in FIG. 1.
Figure 4:
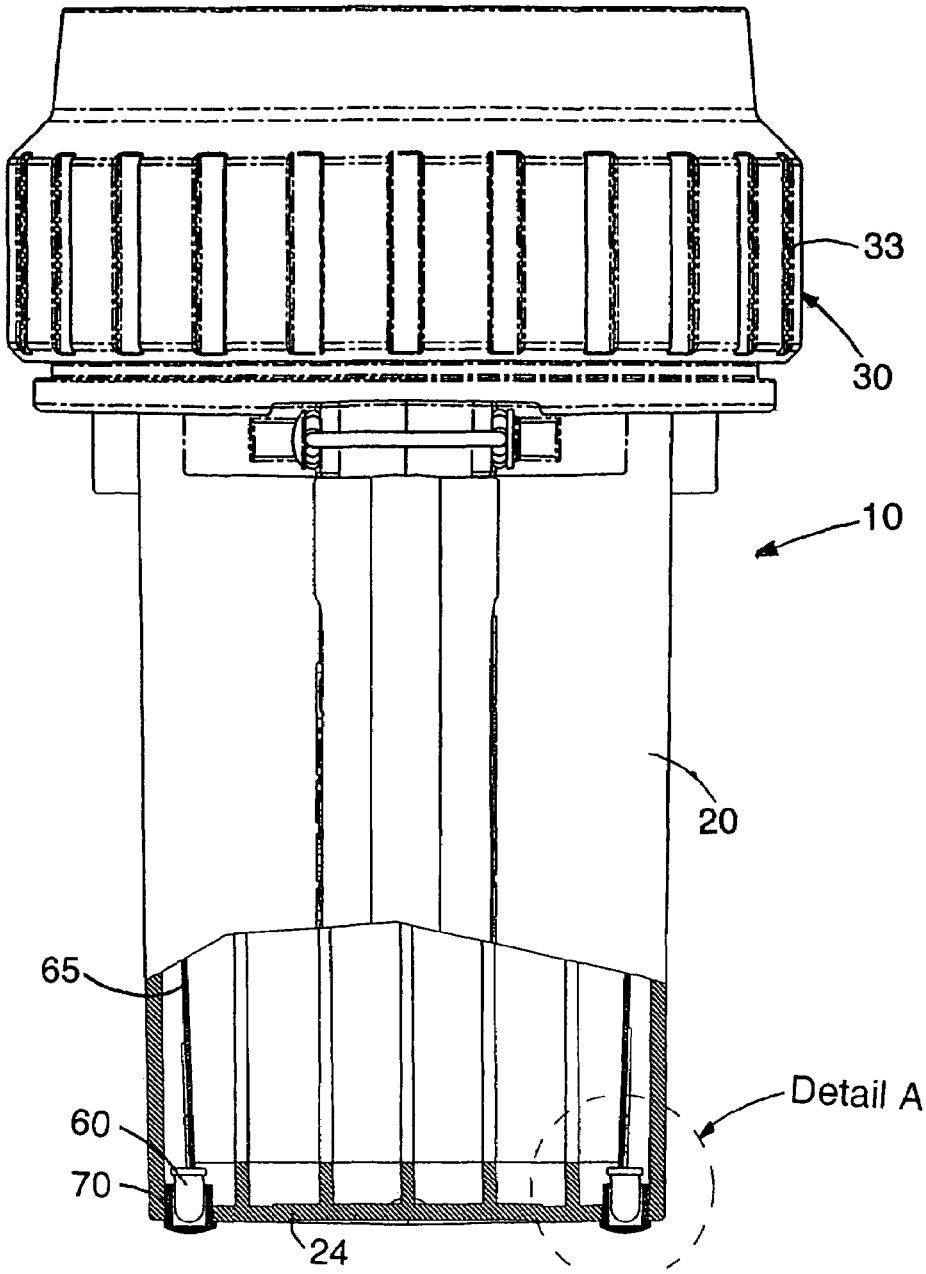
FIG. 4 is a plan view, partially in section of the flashlight illustrated in FIG. 3, taken along the line 4—4.

Referring now to the drawings in general and to FIGS. 1 and 3 specifically, a flashlight is designated generally 10. The flashlight 10 includes a lamp assembly 30 providing a forwardly directed light source, and one or more back lights 60 providing a rearwardly directed light source. The lamp assembly 30 includes a high-powered light to provide general illumination, whereas preferably the back light provides low power light so that the person using the flashlight can be readily identified from behind when using the flashlight.

Figures 2, 2A:
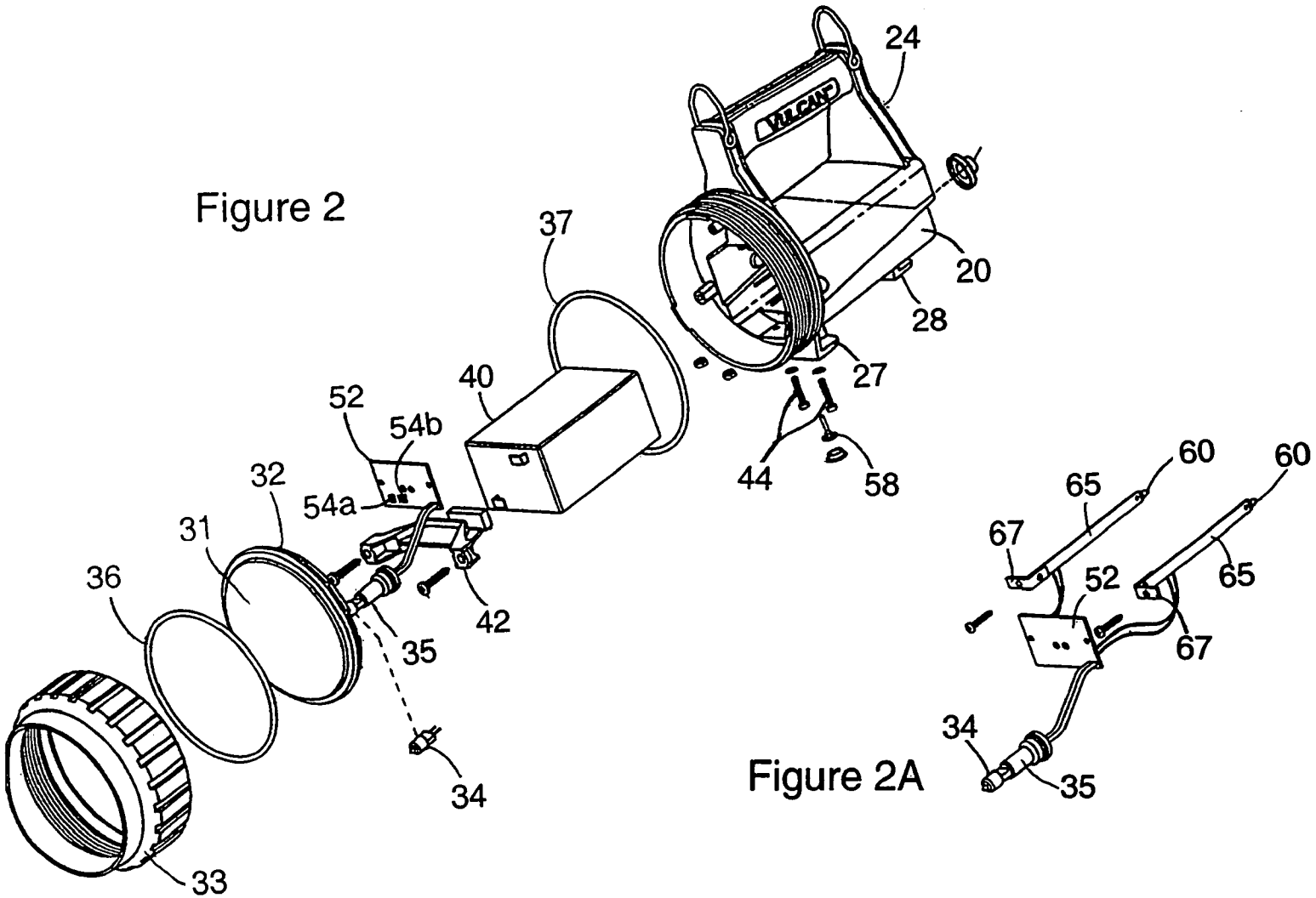
FIG. 2 is an exploded perspective view of the flashlight illustrated in FIG. 1.
FIG. 2A is a perspective view of a portion of the flashlight illustrated in FIG. 1.

Referring now to FIG. 2, an exploded view illustrates most of the elements of the flashlight 10. The flashlight includes a hollow housing 20 having a generally open forward end and a generally closed rearward end. Although the housing 20 may be formed from a variety of material, including various metals and/or plastics, preferably, the housing is formed of high impact ABS.

The forward end of the housing 20 has an externally threaded portion that cooperates with the lamp assembly 30 to attach the lamp assembly to the housing. The lamp assembly 30 preferably includes a lens ring 33, a reflector 32, a lens 31 and a light bulb 34. In the present instance, preferably the lens 31 and the reflector 32 are fixedly connected to one another to form a lens/reflector assembly. However, a separate lens and reflector can also be utilized with the flashlight if desired.

The reflector includes a central aperture for receiving the light bulb 34. More specifically, preferably the light bulb 34 is mounted into a socket 35 and the socket extends into the central aperture of the reflector. In this way, the light bulb 34 projects inwardly into the reflector 32. Preferably, the light socket 35 comprises external threads and the opening in the reflector includes a threaded stem so that the light socket is threadedly connected to the reflector. The light bulb 34 is preferably a high intensity bulb, such as a bulb capable of providing up to 65,000 candlepower. For instance, the light bulb may be an 8 watt halogen bulb or a 6 watt xenon dual filament bulb. Alternatively, the light bulb may be a high intensity, ultra-bright LED.

The lens ring 33 is internally threaded to cooperate with the threaded portion on the front end of the housing 20. The light bulb 34 is connected to the light socket 35, which in turn is inserted into the opening in the reflector. The lens ring 33 is then placed over the lens/reflector and threaded onto the housing so that the reflector/lens is sandwiched between the lens ring and the housing. In addition, to provide a fluid-tight seal between the housing and the lamp assembly 30, preferably a pair of seals 36, 37, such as o-rings, are provided.

The housing includes a compartment configured to receive the battery 40. The battery may be a plurality of separate batteries or a single battery. In addition, the battery 40 may be rechargeable or non-rechargeable. In the present instance, preferably the battery is a 6-volt lead acid rechargeable battery. In addition, preferably a battery clamp 42 holds the battery in place in the housing. Preferably, the battery clamp 42 is similar to a safety bar that confronts the battery. The battery clamp 42 has a central portion formed to cooperate with the top surface of the battery 40, and the ends of the battery clamp have holes for securing the battery clamp. A pair of screws pass through the holes in the ends of the battery clamp and then into internally threaded recesses to screw the battery clamp to the housing.

If the battery is rechargeable, preferably the flashlight 10 includes a pair of charging terminals 44 that cooperate with a battery charger to recharge the battery while the battery remains in the housing. Preferably, the housing 20 comprises a front and back latch 27, 28 projecting from the bottom surface of the housing to cooperate with the charger. The latches operate to connect the flashlight to the charger to secure the flashlight in place on the charger during charging. Preferably, the charging terminals 44 are attached to the forward latch so that the charging terminal on the forward latch engages terminals on the charger to provide an electrical circuit between the charger and the battery.

Since the flashlight is preferably fluid-tight, the flashlight preferably includes a valve allowing escape of gases created by the battery during use. The valve is a one-way valve, allowing gas to pass through the valve and out of the housing, while preventing fluid from entering the housing from outside the housing. In the present instance, the valve projects through a hole in the housing that extends through the front charger latch 27.

Figure 5:
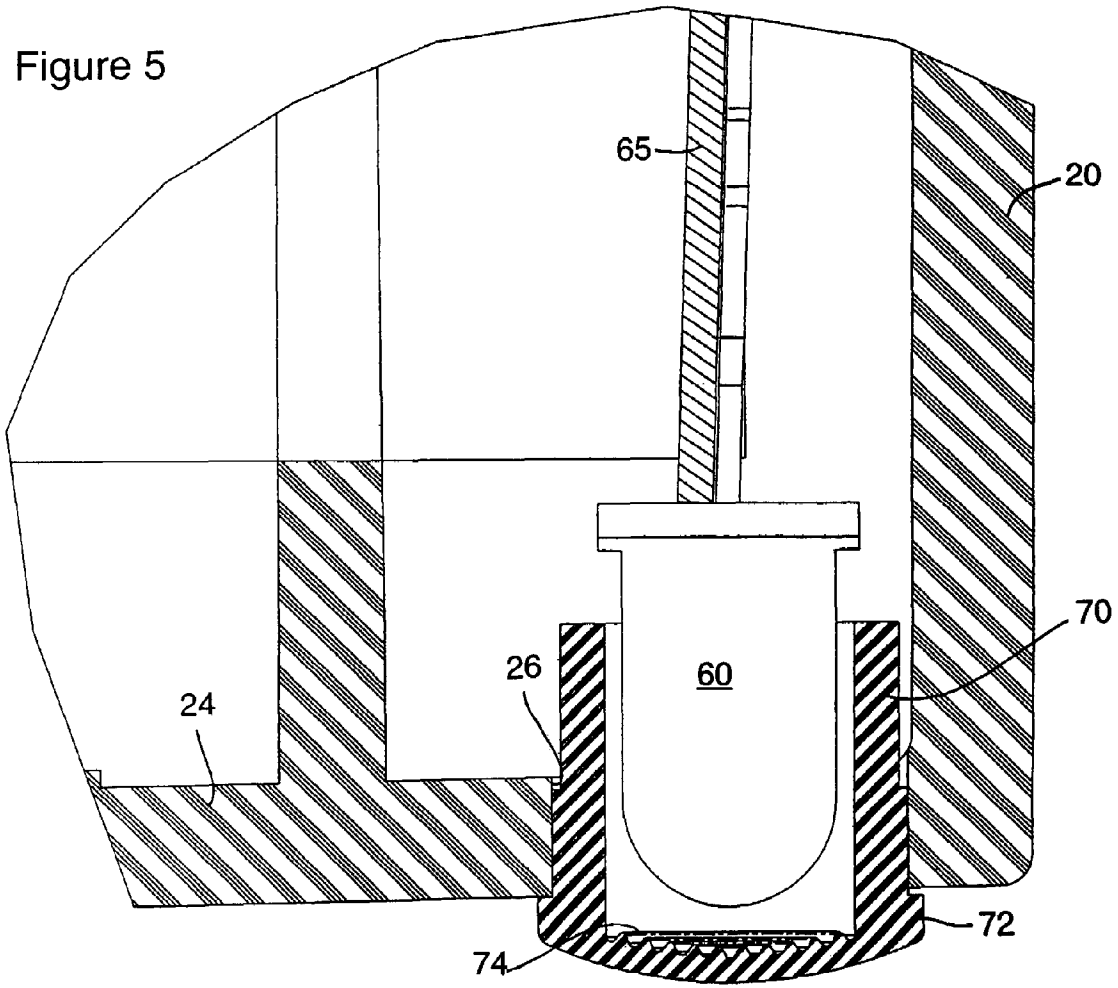
FIG. 5 is an enlarged fragmentary sectional view of the portion of the flashlight in FIG. 4 identified by Detail A.

The rearward end of the housing 20 is generally closed by a back wall 24, which is substantially continuous except for a pair of apertures for the back lights 60. Referring to FIG. 5, the apertures 26 are preferably larger in diameter than the back lights 60 so that the lights can extend into the apertures. Each of the back lights 60 is covered by a cover 70, which encloses each of the back lights 60.

As shown in FIG. 5, each cover 70 is a cup-shaped element. The rearward end of the cover 70 flares outwardly forming an enlarged head 72 having a diameter that is greater than the diameter of the aperture 26. The body portion of the cover 70 is generally cylindrical having an outer diameter that is configured to cooperate with the aperture.

The enlarged head 72 of the cover 70 forms a lens for the back light 60. Accordingly, the head of the cover is transparent or translucent. Depending on the type of light element used for the back light 60, it may be desirable to either focus the light or diffuse the light. However, in typical applications the back light is not primarily provided for illumination so it generally is not desirable to focus the light. Instead, in a typical application the light is used as a signal or locator, so it is desirable to diffuse the light. Accordingly, the cover 70 comprises a diffusion surface 74 for diffusing the light provided by the back lights 60. In applications in which it is desirable to focus the light provided by the back lights 60, a reflector may be provided to focus the rearwardly directed light.

The covers 70 are connected to the housing 20 to seal the apertures 26. In addition, preferably the covers are substantially permanently attached to the housing. Accordingly, the covers 70 may be inserted into the apertures 26 and bonded to the housing. Alternatively, the body portion of the cover may be slightly larger than the apertures to provide an interference fit between the cover and the aperture. In either way, since the head of the cover is preferably larger than the aperture, the head operates as a stop limiting the distance that the cover can be inserted into the aperture. Accordingly, the cover is inserted into the aperture 26 so that the enlarged head abuts the back wall so that the cover is generally flush with the back wall of the housing. Specifically, preferably the cover projects from the back wall a distance that is less than twice a thickness of the back wall, and more preferably a distance that is less than the thickness of the back wall.

Configured as described above, the back lights provide a rearward facing light source that does not project significantly from the back wall of the housing 20. In other words, the back light is substantially enclosed within the housing and the covers are substantially flush with the back wall.

As shown in FIG. 5, the back light 60 is preferably a two pin light element and the pins project into the housing 20. More specifically, preferably the back lights 60 are ultra-bright blue LEDs having two pins. The pins are fixedly connected to conductors 65 that extend between the battery and the back lights 60, as discussed further below.

Referring now to FIG. 1, the operation of the primary lamp 30 and the back lights 60 is controlled by a switch 50. The switch may be configured to have two or more switching positions. However, in the present instance the switch is a toggle switch having three positions, a central or off position, a left position and a right position.

Preferably, the switch 50 cooperates with a switch PCB 52 that controls the operation of the primary lamp and the back lights in conjunction with the switch. The switch PCB is interconnected with the battery 40, the primary lamp element 34, the back lights 60 and the switch 50. In the primary configuration of the switch PCB, the switch controls the flashlight as follows. When the switch is toggled into the left position, continuous power is provided to both the primary lamp 30 and the back lights 60 to provide continuous illumination by the light elements, referred to as a steady mode. When the switch is toggled to the right intermittent power is provided to both the primary lamp 30 and the back lights 60 so that the lights flash, referred to as flashing mode.

Preferably, the flashlight 10 allows the lighting modes to vary from the primary configuration described above. Specifically, preferably the switch PCB 52 comprises a plurality of contacts that are selectively interconnected by a plurality of removable conductive elements, such as jumpers 54*a*, 54*b*, as shown in FIG. 2. By removing one or both of the jumpers, the lighting modes are altered. Specifically, if the first jumper 54*a* is removed, the left switch position turns the primary lamp 30 on in steady mode, but does not turn on the back lights. The right switch position turns on both lights in flashing mode. If the second jumper is removed, the left switch position turns both lights on in steady mode. The right switch position turns on only the back lights in flashing mode. If both jumpers are removed the left position turns on just the primary lamp in steady mode. The rights switch position turns on just the back lights in flashing mode.

The electrical path between the switch PCB 52 and the primary lamp 30 is provided by a conductive cable that is connected to the light socket at one end and to the switch PCB at the other end. The back lights 60 may be similarly connected to the switch PCB. However, preferably, elongated back light PCBs 65 extend between the back lights and the switch PCB. Referring to FIG. 2A, the pins of each of the back lights 60 are soldered directly to one end of a back light PCB 65. A pair of conductive cables are connected to the second end of the PCB connector and also to the switch PCB 52 to complete the electrical path between the back lights and the switch PCB.

The back light PCBs 65 are preferably rigidly connected to the housing 20. Specifically, each of the back light PCBs have a mounting tab 67 fixedly attached to the second end, so that the mounting tab is separated from the electrical path. A fastener, such as a screw, attaches the mounting tab 67 to the housing. Accordingly, the back light PCBs 65 extend within the housing and are preferably spaced apart from the interior wall of the housing.

Figure 6:
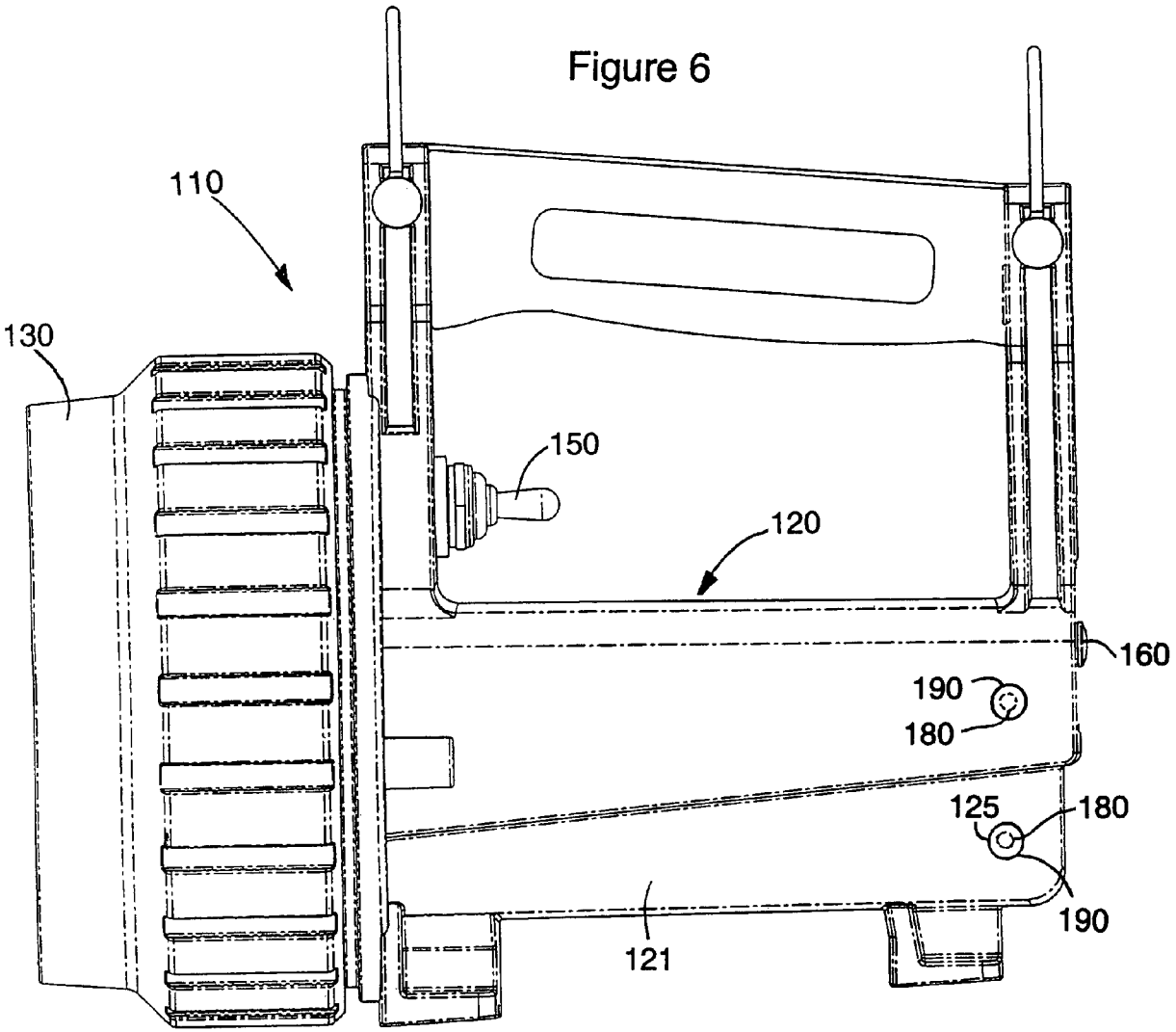
FIG. 6 is a side elevational view of an alternative embodiment of a flashlight.

Referring now to FIG. 6 an alternate embodiment 110 is illustrated with an additional side light option. Elements in the alternative embodiment that are similar to elements in the first embodiment are identified with the same reference numbers with the addition of 100.

The flashlight 110 has a housing that has a front side 121 having apertures 125 for receiving LEDs 180. Preferably, the apertures 125 are configured similarly to the apertures 26 described previously in the first embodiment. In addition, preferably the LEDs 180 are enclosed within the housing 120 by covers 190 that are configured similarly to the covers 70 described above in the first embodiment. In this way, the side lights 180 are enclosed within the housing so that the side lights are substantially flush with the side 121 of the housing. In other words, at least a majority of the length, and preferably substantially the entire length, of the side LEDs 180 are disposed within the apertures 125 and the interior of the housing.

The side LEDs 180 may be provided as an alternative to the back light LEDs described in the first embodiment, so that the flashlight 110 has side lights and a primary lamp 130 similar to the lamp above, but no back lights. However, preferably, the flashlight has back lights 160 similar to the back lights 60 described above. In this way, the flashlight includes a forward light 130, back lights 160 projecting light rearwardly and side lights 180 disposed normal to the back lights and providing a light source directly sidewards from the housing. In addition, preferably the flashlight has side lights on the back side of the housing that are configured and arranged similarly to the sidelights described above. By providing the sidelights and the back lights, the flashlight can be readily seen from either the side or the back.

Preferably, the sidelights are controlled by a switch 150 similar to the switch 50 described above. Preferably the side lights are controlled together with the back lights so that when the back lights are switched on the sidelights are also switched on. However, the switching circuit can be configured to operate the side lights independently from the back lights if desired.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

I claim:

1. A flashlight, comprising:

a housing having a forward end and a rearward end, wherein the forward end is generally open and the rearward end forms a wall having an aperture;

a lamp assembly disposed in the forward end of the housing, having a lamp element configured to provide a beam of light directed forwardly;

an LED element in the aperture in the rearward end of the housing to provide a light source directed rearwardly from the housing, wherein the LED has a length and substantially the entire length of the LED is disposed within the housing;

a cover enclosing the aperture in the rearward end of the housing, wherein the cover is substantially flush with the rearward end of the housing wherein the cover comprises a body portion projecting into the aperture to connect the cover to the housing;

a switch for controlling operation of the lamp assembly and the LED, wherein when the switch is in a first position both the LED and the lamp element are off and when the switch is in a second position both the lamp element and the LED are on, with the LED either flashing or providing steady illumination; and a battery disposed within the housing.

2. The flashlight of claim 1 wherein the LED projects into the aperture in the rearward end of the housing.

3. The flashlight of claim 1 wherein the cover comprises an enlarged head having a diameter greater than the aperture.

4. The flashlight of claim 3 wherein the enlarged head of the LED cover has a surface that confronts the rearward end of the housing so that the LED cover is substantially flush with the rearward end of the housing.

5. The flashlight of claim 1 wherein the switch is disposed adjacent the lamp assembly and the flashlight comprises an elongated conductive element extending between the switch and the LED.

6. The flashlight of claim 5 wherein the elongated conductive element is rigidly connected to the housing.

7. The flashlight of claim 1 wherein when the switch is in the second position the LED is flashing.

8. The flashlight of claim 1 wherein the switch is operable in a third position, wherein the second position the LED is flashing and in the third position the LED provides steady illumination.

9. The flashlight of claim 8 comprising a controller connected with the switch wherein the controller is operable to vary the operation of the LED in the second position, and is operable to vary the operation of the lamp element in the third position.

10. The flashlight of claim 9 wherein the controller comprises a circuit board comprising a removable conductive element for varying the operation of the switch.

11. The flashlight of claim 1 wherein the housing comprises a second aperture in the rearward end of the housing and a second LED aligned with the second aperture so that substantially the entire length of the second LED is disposed within the housing.

12. The flashlight of claim 1 wherein the lamp assembly comprises an incandescent light bulb.

13. The flashlight of claim 1 wherein the lamp assembly comprises a reflector for focusing the light from the lamp element.

14. A flashlight comprising:

a hollow housing having an interior and comprising a forward end and a rearward end having a back wall, wherein an aperture is formed in the back wall;

a lamp assembly connected with the forward end of the housing, comprising a lamp element to provide a light source projecting forwardly;

an LED providing a light source projecting rearwardly from the housing, wherein the LED is disposed within the aperture so that a majority of the length of the LED is disposed within the aperture and the interior of the housing;

a cover attached to the back wall of the housing that covers the LED and the aperture, wherein the cover has an enlarged head having a thickness that is less than double the wall thickness of the back wall, and the enlarged head confronts the back wall so that the enlarged head of the cover projects from the back wall less than approximately twice the wall thickness of the back wall;

a switch for selectively controlling the operation of the lamp assembly and the LED; and a battery for providing power for the lamp element and the LED.

15. The flashlight of claim 14 comprising an elongated printed circuit board extending along a side of the housing wherein the LED is connected directly to the printed circuit board.

16. The flashlight of claim 14 wherein the housing comprises a side wall having a second aperture, and the flashlight comprises a second LED providing a light source projecting sidewardly from the housing, wherein the second LED is disposed within the second aperture.

17. The flashlight of claim 14 wherein the cover has an enlarged head having a diameter that is larger than the diameter of the aperture.

18. The flashlight of claim 14 comprising a diffusion element for diffusing the light from the LED.

19. The flashlight of claim 14 comprising a switch controller connected with the switch, wherein the switch controller is operable to vary the operation of the lamp element and/or the LED when the switch element is switched into a first position.

20. The flashlight of claim 19 wherein the switch controller is operable to vary the operation of the lamp element and/or the LED when the switch element is switched into a second position.

21. The flashlight of claim 14 wherein the battery is disposed within the housing.

22. The flashlight of claim 14 comprising at least one seal for providing a fluid-tight seal within the housing.

23. The flashlight of claim 14 wherein the lamp element provide greater candle power than the LED.

24. A flashlight comprising:

a hollow housing comprising a forward end and a rearward end having a back wall, wherein an opening is formed in the back wall;

a lamp assembly connected with the forward end of the housing, comprising a lamp element to provide a light source projecting forwardly;

an LED providing a light source projecting rearwardly from the housing, wherein a portion of the LED is disposed within the opening;

a cover enclosing the opening in the rearward end of the housing, wherein the cover is generally flush with the rearward end of the housing and the cover comprises a body portion projecting into the opening to connect the cover to the housing;

a switch for controlling operation of the lamp assembly and the LED, wherein the switch is operable in a first position in which both the LED and the lamp element are off and a second position in which both the lamp element and the LED are on, with the LED either flashing or providing steady illumination; and a battery for providing power for the lamp element and the LED.

25. The flashlight of claim 24 comprising an elongated printed circuit board extending along a side of the housing wherein the LED is connected directly to the printed circuit board.

26. The flashlight of claim 25 wherein the housing comprises a side wall having a second opening and the flashlight comprises a second LED providing a light source projecting sidewardly from the housing, wherein a portion of the second LED is disposed within the second opening.

27. The flashlight of claim 26 wherein the cover has an enlarged head having a diameter that is larger than the diameter of the second opening.

28. The flashlight of claim 26 wherein the cover has an enlarged head having a thickness that is less than double the wall thickness of the back wall, and the enlarged head confronts the back wall so that the enlarged head of the cover projects from the back wall less than approximately twice the wall thickness of the back wall.

29. The flashlight of claim 26 comprising a diffusion element for diffusing the light from the LED.

30. The flashlight of claim 24 comprising a switch controller connected with the switch, wherein the switch controller is operable to vary the operation of the lamp element and/or the LED when the switch element is switched into a first position.

31. The flashlight of claim 24 wherein the battery is disposed within the housing.

32. The flashlight of claim 24 comprising at least one seal for providing a fluid-tight seal within the housing.

33. The flashlight of claim 24 wherein the lamp element provides light having greater candle power than the light of the LED.

34. The flashlight of claim 24 wherein the cover comprises an enlarged head having a diameter greater than the aperture.

35. A flashlight comprising:

a hollow housing having an interior and comprising a forward end, a rearward end having a back wall, and a side wall, wherein a first opening is formed in the back wall and a second opening is formed in the side wall;

a lamp assembly connected with the forward end of the housing, comprising a lamp element to provide a light source projecting forwardly;

a back LED providing a light source projecting rearwardly from the housing, wherein a portion of the back LED is disposed within the first opening;

a side LED providing a light source projecting sidewardly from the housing, wherein a portion of the side LED is disposed within the second opening;

a switch for controlling operation of the lamp assembly, the back LED and the side LED; and a battery for providing power for the lamp element and the back light.

36. The flashlight of claim 35 comprising a first cover attached to the back wall of the housing that covers the back LED and the first opening.

37. The flashlight of claim 36 comprising a second cover attached to the side wall of the housing that covers the side LED and the second opening.

38. The flashlight of claim 35 wherein the back LED and the side LED are disposed within the first and second openings so that a majority of the length of the back LED and the side LED is disposed within the first and second openings and the interior of the housing.

39. The flashlight of claim 38 wherein the first and second covers each comprise a diffusion element for diffusing the light from the back LED and the side LED.

40. A flashlight comprising:

a hollow housing;

a lamp assembly connected with the forward end of the housing, comprising a lamp element to provide a light source projecting forwardly;

an LED providing a light source projecting rearwardly from the housing;

a switch for controlling operation of the lamp assembly and the LED;

a switch controller connected with the switch, wherein the switch controller is operable to vary the operation of the lamp element and/or the LED when the switch element is switched into a first position wherein the switching controller comprises a removable electrical connector operable to alter the electrical path between the battery and the lamp and/or the LED;

a switching circuit connected with the switch, wherein the switch controller is operable to vary the switching circuit; and a battery for providing power for the lamp element and the back light.

41. The flashlight of claim 40 wherein the switch is operable in three positions, a first position in which both the LED and the lamp element are off, a second position in which at least the lamp element is on and a third position in which at least the LED is on.

42. The flashlight of claim 41 wherein the controller is operable to vary the operation of the LED in the second position, and is operable to vary the operation of the lamp element in the third position.

43. The flashlight of claim 40 wherein the switching controller is operable in a plurality of settings wherein varying the controller setting varies the condition of the lamp element and/or the LED for one of the switching positions.

44. The flashlight of claim 43 wherein when the controller is in a first setting and the switch is in the first position, the lamp element is in a first condition and the LED is in a first condition, and wherein when the controller is in a second setting and the switch is in the first position, the lamp element and/or the LED are in a second condition.

45. The flashlight of claim 44 wherein the first condition for the lamp is one of steady illumination, flashing and off, and the second condition is a different one of steady illumination, flashing and off.

46. The flashlight of claim 40 wherein the switching controller comprises a removable electrical connector operable to alter the electrical path between the battery and the lamp and/or the LED.

47. A flashlight comprising:

a body configured to receive a battery, wherein the body has a back having an opening;

a lamp connected with the body, and operable to provide a light source projecting forwardly;

a taillight providing light projecting rearwardly from the body, wherein the taillight comprises an LED;

a cover attached to the back wall of the housing that covers the LED and the opening, wherein the cover has an enlarged head having a thickness that is less than double the wall thickness of the back wall, and the enlarged head is positioned so that the enlarged head of the cover projects from the back wall less than approximately twice the wall thickness of the back wall;

a switch for controlling operation of the lamp assembly and the LED, wherein when the switch is in a first position both the LED and the lamp element are off and when the switch is in a second position both the lamp element and the LED are on, with the LED either flashing or providing steady illumination; and a battery positioned within the body and operable to provide power for the lamp element and the LED.

48. The flashlight of claim 47 wherein the taillight comprises a plurality of LEDs.

49. The flashlight of claim 47 comprising at least one seal for providing a fluid-tight seal within the housing.

50. The flashlight of claim 47 wherein when the switch is in the second position, the LED is flashing.

51. The flashlight of claim 47, wherein the body comprises a rear wall having a surface area, and an aperture through the rear wall, wherein the surface area of the rear wall is substantially larger than the area of the aperture.

* * * * *

UNITED STATES PATENT AND TRADEMARK OFFICE

CERTIFICATE OF CORRECTION

PATENT NO. : 7,059,744 B2
APPLICATION NO. : 10/703993
DATED : June 13, 2006
INVENTOR(S) : Raymond Sharrah It is certified that error appears in the above-identified patent and that said Letters Patent is hereby corrected as shown below:

Col. 8, line 12-13;

Claim 30, lines 4-5, "switched into a first position."
should read -- switched into the second position. --;

Signed and Sealed this

Twelfth Day of September, 2006

JON W. DUDAS
*Director of the United States Patent and Trademark Office*